US006431420B1

(12) United States Patent
Cragg

(10) Patent No.: US 6,431,420 B1
(45) Date of Patent: Aug. 13, 2002

(54) RELOADABLE FUSE DISPENSING SYSTEM

(76) Inventor: James Victor Cragg, P.O. Box 260981, Encino, CA (US) 91426-0981

( * ) Notice: Subject to any disclaimer, the term of this patent is extended or adjusted under 35 U.S.C. 154(b) by 0 days.

(21) Appl. No.: 09/593,834

(22) Filed: Jun. 13, 2000

(51) Int. Cl.[7] ..... A45F 5/00

(52) U.S. Cl. ..... 224/223; 224/222; 224/661; 224/677; 224/684; 224/901.8; 224/931

(58) Field of Search ..... 224/196, 219, 224/222, 223, 661, 675, 684, 901.8, 931, 271, 267, 677; 102/275.12

(56) References Cited

U.S. PATENT DOCUMENTS 72,011 A * 12/1867 Freeborn
1,094,009 A * 4/1914 Parkhurst
4,848,624 A * 7/1989 Clem
5,152,441 A * 10/1992 Torena
5,375,749 A * 12/1994 Oliva ..... 224/242
5,443,192 A * 8/1995 Hodges et al. ..... 224/148.6
5,586,703 A * 12/1996 Radar et al.
6,036,068 A * 3/2000 Cartmell
6,065,659 A * 5/2000 Faz

* cited by examiner

*Primary Examiner*—Gregory M. Vidovich
(74) *Attorney, Agent, or Firm*—Raymond Y. Chan; David and Raymond Patent Group

(57) ABSTRACT

A reloadable fuse dispensing system includes a carrier adapted to be detachably fastened on a user's body and a dispenser which is detachably attached to the carrier and includes a dispenser body and a fuse holder arrangement which is mounted on the dispenser body for detachably webbing a predetermined length of fuse in a daisy chained manner. During combat, the user simply attaches a pre-loaded dispenser on the carrier and feeds out the fuse from the dispenser in order to fire the explosion quickly and easily. For next detonation, ripping out the used dispenser and replacing a pre-loaded one, the user is then ready to move to next target for another shot.

23 Claims, 5 Drawing Sheets

RELOADABLE FUSE DISPENSING SYSTEM

BACKGROUND OF THE PRESENT INVENTION

1. Field of Invention

The present invention relates to shock tube and fuse dispensing system, and more particularly to a reloadable fuse dispensing system for breachers, wherein shock tubes and time fuses can be deployed in a daisy chain dispenser which is reloadable, easy to use, and compact for carriage.

2. Description of Related Arts

In modern urban combat operation, breachers or explosive entry technicians which need to make explosive entry into multiple rooms and/or multiple buildings in order to fire an explosive device. For finishing their tasks, breachers or explosive entry technicians have to carry at least a coil of wire and a plurality of shock tubes wherein the coiled wire and the shock tubes may be loaded in a bag such that the breachers may carry the heavy loaded bag around all the designated rooms or buildings. In such situation, two breachers may need to set up the explosion in one task, wherein one breacher carries the heavy coiled wire while the other breacher carries another necessaries such as fuses and shock tubes. If there is a one-man task, the breacher cannot move quick enough to dispense the wire and shock tubes when he is carrying the heavy loaded bag. Furthermore, the designated time for explosion may be delayed because of the interruption of retreating and, worse, breachers may get hurt during explosion.

The coil of wire usually has a predetermined length that is long enough to be used in several explosions. However, the breachers have to determine the optimum length of the wire is needed in one explosion by their own experiences in order to stay out of the explosive zone. Furthermore, every time before the task, the breachers have to measure the length of the wire so as to ensure the wire is long enough to use. Since the wire cannot be reloaded in such situation, such that when a coil of wire is used, the breacher must take another coil of fuse in order to set up the explosion. In other words, the breacher must carry an extra coil of wire in case of more than one explosion are needed to be done. The extra-coiled wire will increase the load of the breacher.

SUMMARY OF THE PRESENT INVENTION

A main object of the present invention is to provide the combat troops and lawenforcement breachers or explosive entry technicians with a reloadable fuse dispensing system which enables the breachers to quickly dispense the initiation system cord or wire, such as shock tube and time fuse, and to quickly replace a preloaded dispenser.

Another object of the present invention is to provide a reloadable fuse dispensing system, which dispensers are quickly reloadable, easy to use and compact and convenience for carry.

Another object of the present invention is to provide a reloadable fuse dispensing system, which is easy to use wherein the breachers can simply place the shock tube and the fuse into a charge and feed out the wire from the dispenser.

Another object of the present invention is to provide a reloadable fuse dispensing system, wherein the dispenser is compact to carry by detachably fastening on the breacher's body such as thigh or chest.

Another object of the present invention is to provide a reloadable fuse dispensing system, wherein a predetermined length of wire is loaded in the dispenser that the breachers are able to determine the need of the wire in every single detonation.

Another object of the present invention is to provide a reloadable fuse dispensing system wherein the wire is daisy chained in the dispenser so as to prevent the wire from being intertwined each other while dispensing the wire.

Another object of the present invention is to provide a reloadable fuse dispensing system wherein the pre-loaded dispensers can be easily mounted on and dismounted after use from a carrier which is adapted to be detachably attached to the breacher's body.

In order to accomplish the above objects, the present invention provides a reloadable fuse dispensing system, comprising:

- a carrier which is detachably fastened on a user's body; and
- a dispenser, which is detachably attached to the carrier, comprising a dispenser body, a fuse holder arrangement which is mounted on the dispenser body for detachably webbing a predetermined length of fuse in daisy chained manner, and an accessory pocket adapted for carrying shock tubes.

DETAILED DESCRIPTION OF THE PREFERRED EMBODIMENT

Figure 1:
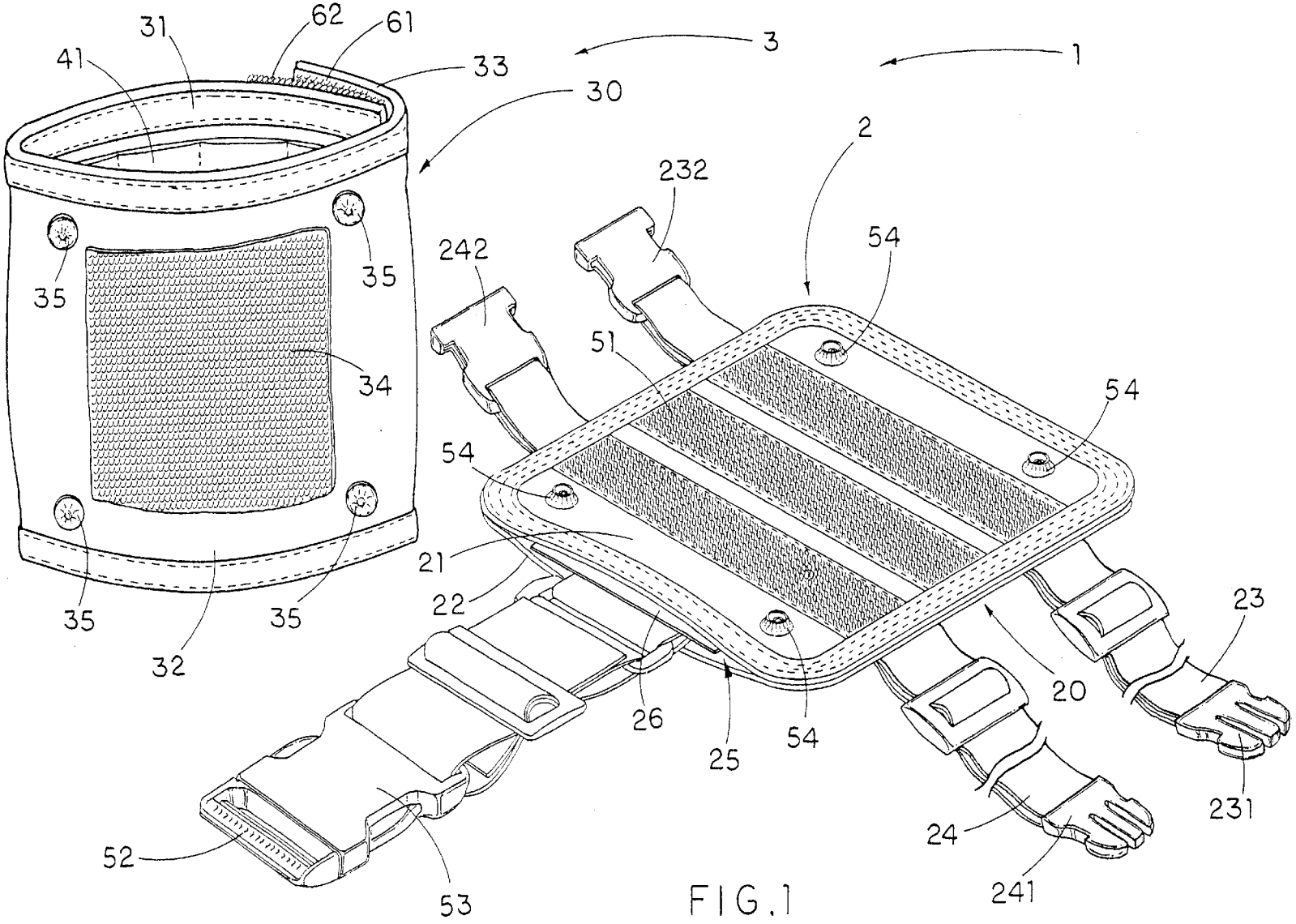
FIG. 1 is a perspective view of a reloadable fuse dispensing system according to a preferred embodiment of the present invention.

Referring to FIG. 1 of the drawings, a reloadable fuse dispensing system 1 according to a preferred embodiment of the present invention is illustrated, which is an innovative system to carry and dispense a wire, fuses, and shock tubes quickly and easily. The reloadable fuse dispensing system 1 comprises a carrier 2 and a dispenser 3 detachably attached to the carrier 2.

The carrier 2, according to a preferred embodiment, comprises a pad body 20 having a front side 21 and a rear side 22, a first fastening element 51 provided on each of the front side 21 and rear side 22 of the pad body 20, and at least a fastener 52 extended from one side of the pad body 20. The pad body 20 can be detachably attached to the user's uniform such as breacher's uniform by attaching the first fastening element 51 of the rear side 22 of the pad body 20 to the user's uniform. Or, alternatively, the carrier 2 can be detachably mounted on the user's chest, thigh or waist position by connecting the uniform buckle 53 to the fastener 52 which is affixed to a shoulder strap or waist belt provided on the chest or thigh portion of the user's uniform.

As shown in FIG. 1, the carrier 2 may further comprises a pair of leg straps 23, 24 affixed to a vertical side of the pad body 20. A pair buckle plugs 231, 241 are provided at two free ends of the leg straps 23, 24 for detachably connecting with a pair of buckle sockets 232, 242 affixed to another vertical side of the pad body 20, so that the carrier 2 can be further firmly mounted on the leg of the user by wrapping the leg straps 23, 24 around the leg of the user and buckling up the buckle plugs 231, 241 and the buckle sockets 232, 242.

The dispenser 3 comprises a fabric made dispenser body 30 constructed in a pad form, which is divided into a first panel 31, a second panel 32 extended from the first panel 31, and a cover panel 33 integrally extended from the second panel 32. Therefore, the dispenser body 30 can be fitly tri-folded into a rectangular shape folder by first folding the first panel 31 on the second panel 32 and then folding the cover panel 33 on top of the first panel 31.

A second fastening element 34 is provided on an outer surface of the second panel 32. Therefore, the dispenser 3 is adapted to detachably mount on the carrier 2 by attaching the second fastening element 34 to the first fastening element 51 of the front side 21 of the pad body 20 of the carrier 2 in such a manner that the user is capable of holding the dispenser 3 with the carrier 2 for carrying the dispenser 3 with hands free and detaching the dispenser 3 for usage. A set of snap fasteners 54, 35 can be provided correspondingly on the front side 21 of the pad body 20 and the outer surface of the second panel 32 for further detachably holding the dispenser 3 to the carrier 2.

Figure 2:
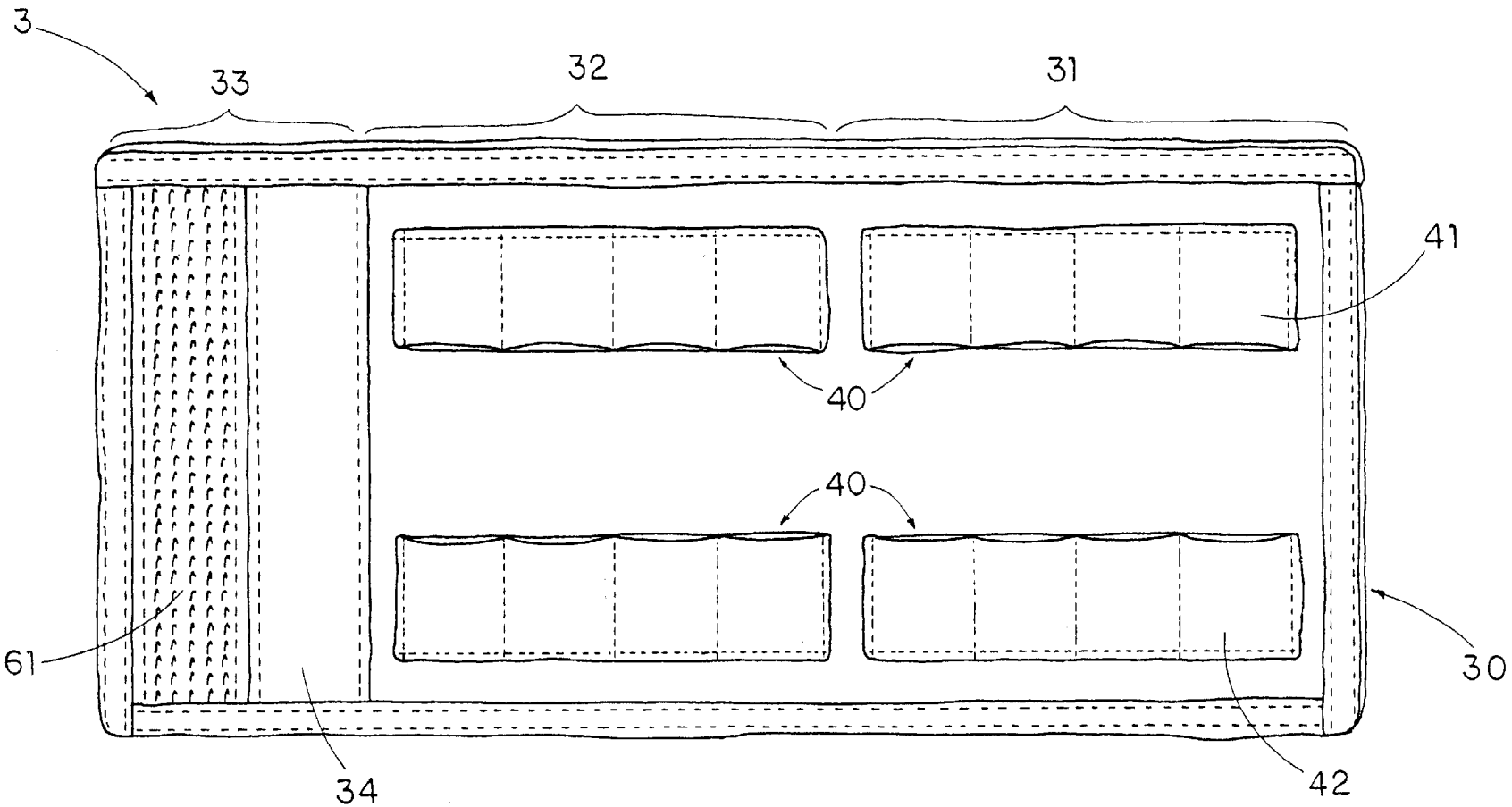
FIG. 2 is a front view of a dispenser of the reloadable fuse dispensing system according to the above preferred embodiment of the present invention.

As shown in FIGS. 1 and 2, a loop fastener 61 is provided on an inner surface of the cover panel 33 and a hook fastener 62 is provided on an outer surface of the first panel 31. Therefore, the cover panel 33 can be connected with the first panel 31 by attaching the loop fastener 61 with the hook fastener 62 so as to close up the dispenser body 30. Preferably, the cover panel 33 has a width shorter than a width of the first panel 31 of the dispenser body 30 such that the dispenser body 30 is easily to be folded and opened.

Figure 3:
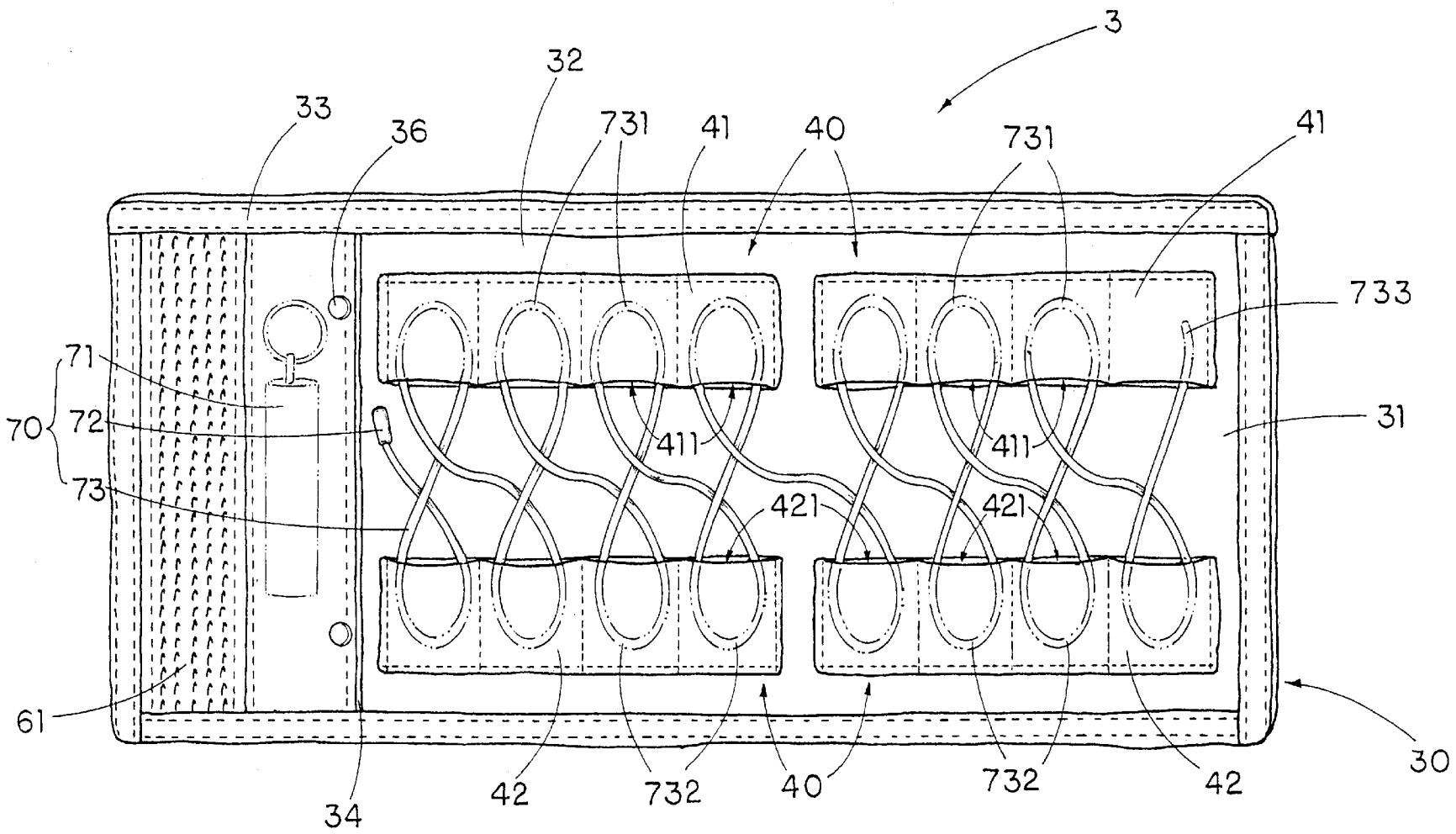
FIG. 3 is a front view of the dispenser of the reloadable fuse dispensing system according to the above preferred embodiment of the present invention, illustrating a wire being daisy chained on the dispenser.

Referring to FIGS. 2 and 3, the dispenser 3 further comprises an accessory pocket 34 for placing accessories of firing devices 70 including ingitors or shock tubes 71 and fuse caps 72, wherein the accessory pocket 34 is integrally formed on an inner side of the cover panel 33 of the dispenser body 30. Snap fasteners 36 are provided at an opening of the accessory pocket 34 for tightly closing the accessory pocket 34 so as to securely place the firing devices inside the accessory pocket 34.

The dispenser 3 further comprises a fuse holder arrangement 40 for holding the loops of fuse 73 in such manner the fuse 73 is daisy chained, as shown in FIG. 3, that is the main feature of the present invention. The fuse holder arrangement 40 comprises an upper holder 41 and a lower holder 42 respectively affixed at an upper portion and a lower portion of the first and second panels 31, 32 of the dispenser body 30.

Preferably, both the upper holder 41 and the lower holder 42 of the fuse holder arrangement 40 are made of elastic material such as elastic strap. The upper holder 41 and the lower holder 42 are spacedly sewn to respectively form a plurality of upper holding pockets 411 and a plurality of lower holding pockets 421 to serve as upper and lower loop holders. Therefore, by looping the fuse 73 in continuous "8" shaped to form a plurality of upper loops 731 and lower loops 732 continuously, the predetermined length of fuse 73 can be securely mounted in the dispenser by holding the upper and lower loops 731, 732 by the upper and lower loop holders 411, 421.

Referring to FIG. 3 of the drawing, the predetermined length of the fuse 73 is webbed in form of daisy-chained arrangement in the dispenser body 30 of the dispenser 3. As mentioned above, the fuse 73 forms a plurality of loops 731, 732 wherein each loop of the fuse 73 is adapted to be held on the loop holder 411, 421 of the upper and lower holders 41, 42 of the fuse holder arrangement 40 such that the loops 731, 732 of the fuse 73 are arranged to be held from one upper loop holder 411 to another lower loop holder 421 in sequence. In such daisy chained arrangement, the fuse 73 can prevent from being intertwined each other while dispensing the fuse 73.

In order words, by inserting the upper loops 731 into the upper holding pockets 411 and the lower loops 732 into the lower holding pockets 421 one by one, the elastic feature of the upper holder 41 and lower holder 42 will apply a downward force to firmly hold the upper and lower loops 731, 732 in position.

However, when a pulling force is applied to a free end 733 of the fuse 73, the upper and lower loops 731, 732 of the fuse 73 can easily be pull out of the respective upper and lower holding pockets 411, 421 orderly one by one in order to dispense a desired length of the fuse 73 for use.

Figure 4:
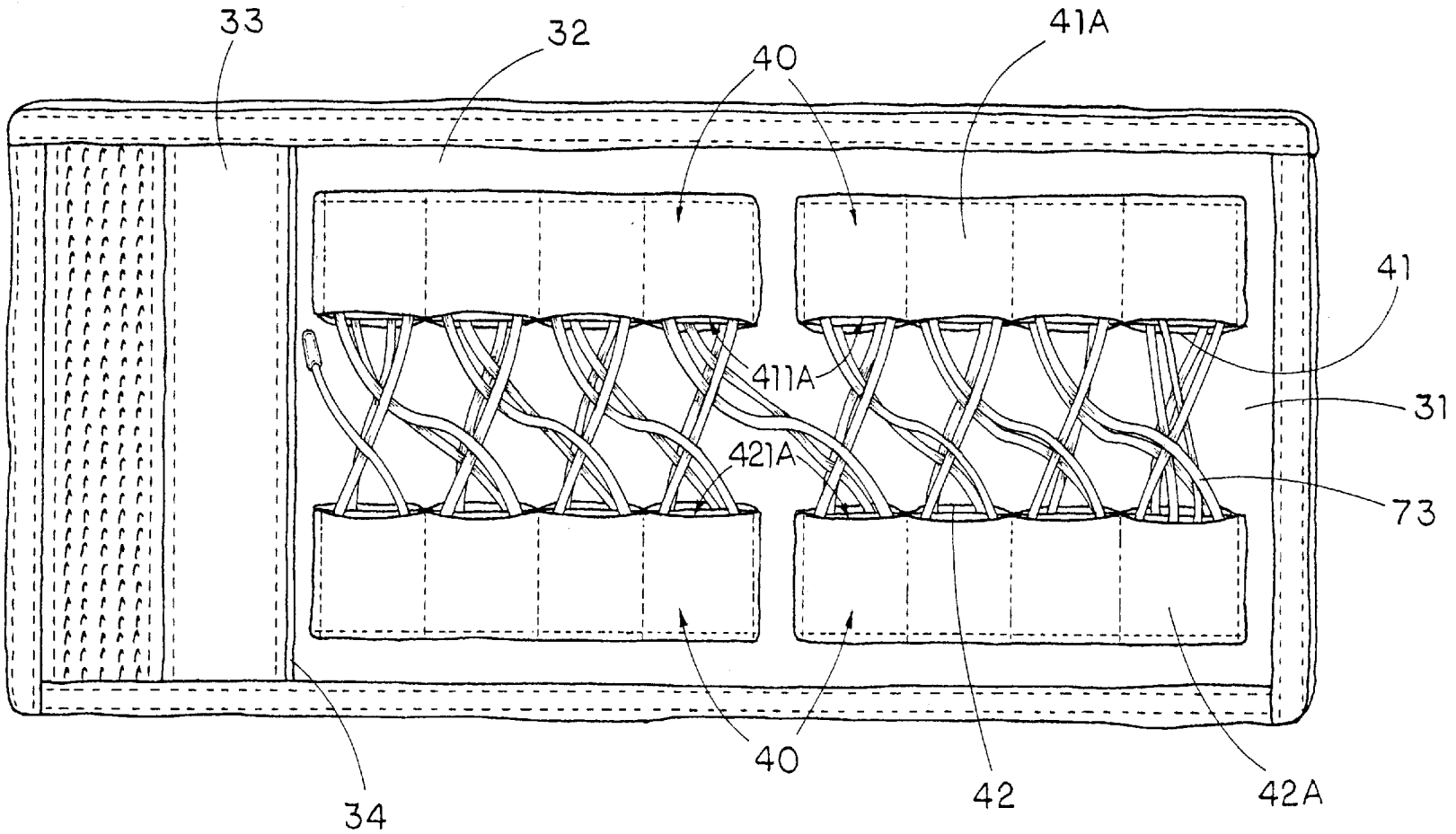
FIG. 4 is a front view of the dispenser of the reloadable fuse dispensing system according to the above preferred embodiment of the present invention, illustrating a second layer of the pouches.

According to the first embodiment of the present invention, the plurality of upper holding pockets 411 and the plurality of lower holding pockets 421 are integrally linked each other respectively, wherein the elastic strap of each upper and lower holds 41, 42 is stitched at evenly intervals to form the plurality of holding pockets 411, 421. For further modification, a second layer (or even a third layer) of the elastic strap is stitched on top the first layer of elastic strap in order to form second layers of upper holders 41 A and lower holders 42A. In such arrangement, a double length of fuse 73 can be wedded in the dispenser body 30 by first filling up the bottom layer of upper and lower holders 41, 42 and then wedding on the upper and lower holding pockets 411 A, 421 A of the second layer of upper and lower holders 41A, 42A, as shown in FIG. 4.

Figure 5:
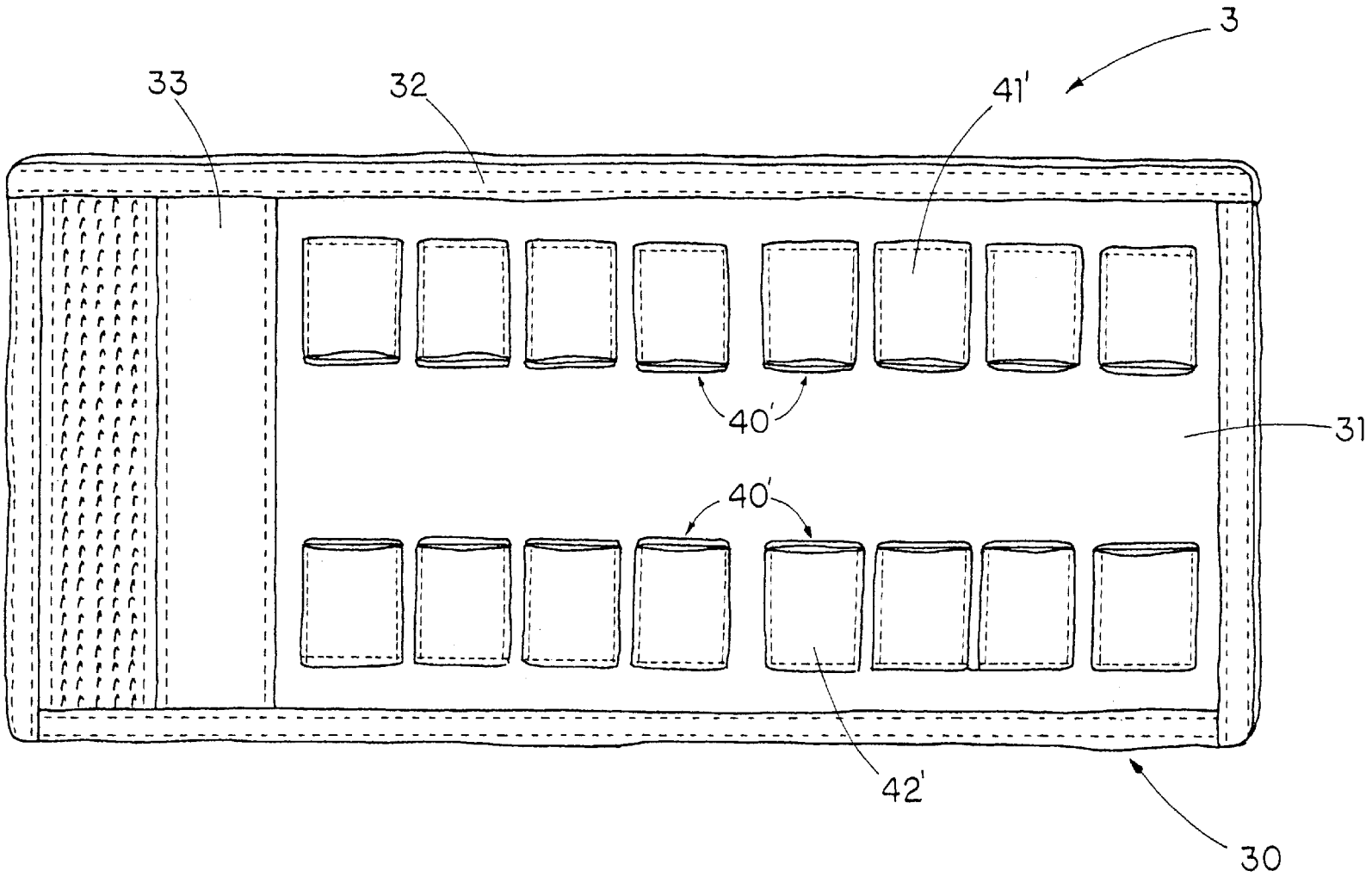
FIG. 5 is a front view of an alternative mode of the fuse holder arrangement of the dispenser according to the above preferred embodiment of the present invention.

FIG. 5 illustrates an alternative mode of the above preferred embodiment of the present invention, wherein the fuse holder arrangement 40' is modified as a plurality of individual loop holders such that each plurality of upper and lower loop holders 41' 42' are formed by a plurality of holder pockets separately mounted thereon respectively. Preferably, the plurality of individual loop holders 41', 42' are made of an elastic strap each having an evenly width and are separately and evenly stitched on the upper and lower portion of the first and second panel 31, 32 of the dispenser body 30 respectively in rows so as to form the upper loop holders 41' and the lower loop holders 42'. Furthermore, second layer of the elastic strap having the same width of the first layer can be stitched and covered on the first layer in order to form a second row of fuse holder arrangement 40'.

The carrier 2 further comprises a protective pocket 25 provided in the pad body 20 wherein a protective metal plate 26 is adapted to be inserted into the protective pocket 25 for shielding the user from the blast of an accidental discharge of the caps. Furthermore, the fastening elements 51, 34 according to the preferred embodiment and its alternative mode, can be hook and loop fasteners, snap fasteners, buckles, straps with cinch or such similar attachments for fastening two members together.

In order to operate the reloadable fuse dispensing system 1, the carrier 2 is securely mounted on the user's body. A pre-loaded dispenser 3 is detachably attached on the carrier 2 such that the user is hand free to carry the dispenser 3. When a charger is already set up, detaches and opens the dispenser 3 and pull out the firing devices, including the shock tube 71 and the cap 72 from the accessory pocket 34 to the charger. Simply feeding out the fuse 73 stored in the dispenser 3 and leaving out the explosive zone until the user is safe, the user will fire the explosion. For the next detonation, ripping off the used dispenser and replacing another pre-loaded dispenser, such that the user will save time to reload the wire and ready to move to next target rapidly. It is worth to mention that a predetermined length of the wire is daisy chained in the dispenser 3 so that a long length of fuse 73 can be packed in a relatively compact size of dispenser 3 and the user is able to determine a distance from the charger in order to reach a safety zone. Furthermore, the fuse 73 is daisy chained in the dispenser 3 so as to prevent the fuse 73 from being intertwined each other while feeding out the fuse 73.

What is claimed is:

1. A reloadable fuse dispensing system, comprising:

a carrier adapted for detachably fastening on a user; and one or more dispensers, each of which is arranged to be detachably attached to said carrier and comprises:

a dispenser body having an upper portion and a lower portion provided on an inner side thereof;

a fuse holder arrangement mounted on said dispenser body for detachably holding said fuse wire in position, wherein said fuse holder arrangement comprises an upper holder and a lower holder affixed on said upper portion and said lower portion respectively, wherein said upper holder comprises a plurality of upper loop holders made of elastic material and said lower holder comprises a plurality of lower loop holders made of elastic material; and a predetermined length of fuse wire, which is folded by looping in a "8" shape manner to form a plurality of upper loops and lower loops continuously that a width of each of said upper and lower loops is slightly smaller than a width of each of said upper and lower loop holders, wherein said upper loops are respectively held in position by said upper loop holders one by one in sequence while said lower loops are respectively held in position by said lower loop holder one by one in sequence so as to wed said fuse wire in a daisy chained manner for securely mounting said fuse wire in said dispenser body.

2. The reloadable fuse dispensing system, as recited in claim 1, wherein each of said upper and lower holders of said fuse holder arrangement comprises a first elastic strap which is spacedly sewn to form a plurality of upper and lower holding pockets to serve as said upper and lower loop holders respectively, wherein said upper loops and lower loops of said fuse wire are held in said upper loop holders of said upper holder and said lower loop holders of said lower holder respectively in such a manner that said upper loops are respectively inserted into said holding pockets of said upper holder one by one in sequence while said lower loops are respectively inserted into said holding pockets of said lower holder one by one in sequence.

3. The reloadable fuse dispensing system, as recited in claim 2, wherein said fuse holder arrangement further comprises at least a second layer of upper holder and lower holder which are second elastic straps stitched on top of said first elastic straps respectively, wherein said second elastic straps are also spacedly sewn to form a plurality of upper and lower pockets to serves as upper and lower loop holders of said second layer of upper holder and lower holder respectively for continuously holding said upper loops and lower loops of said fuse wire in position, whereby said dispenser body is capable of mounting an additional length of said fuse wire by wedding said fuse wire on said upper and lower holding pockets of said second layer of upper holder and lower holder of said second elastic straps respectively after filing up said upper and lower holding pockets of said first elastic straps.

4. The reloadable fuse dispensing system, as recited in claim 1, wherein said plurality of upper and lower loop holders are formed by a plurality of individual holder pockets separately mounted on said dispenser body respectively, wherein said individual loop holders are made of elastic straps each having a same width and are separately and evenly stitched on said upper and lower portion of said dispenser body in rows, wherein said upper loops and lower loops of said fuse wire are held in said upper loop holders of said upper holder and said lower loop holders of said lower holder respectively in such a manner that said upper loops are respectively inserted into said holder pockets of said upper holder one by one in sequence while said lower loops are respectively inserted into said holder pockets of said lower holder one by one in sequence.

5. The reloadable fuse dispensing system, as recited in claim 4, wherein said fuse holder arrangement further comprises at least a second layer of upper holder and lower holder which are additional individual holder pockets made of elastic straps each having a same width and separately and evenly stitched on said upper loop holders and said lower loop holders of said upper holder and said lower holder stitched on said upper and lower portions of said dispenser body respectively, whereby said dispenser body is capable of mounting an additional length of said fuse wire by wedding said fuse wire on said upper and lower holder pockets of said second layer of upper holder and lower holder respectively after filing up said upper and lower holders thereunder.

6. The reloadable fuse dispensing system, as recited in claim 1, further comprises a shock tube and a cap, wherein said dispenser body further has an accessory pocket provided to receive said shock tube and said cap therein.

7. The reloadable fuse dispensing system, as recited in claim 3, further comprises a shock tube and a cap, wherein said dispenser body further has an accessory pocket provided to receive said shock tube and said cap therein.

8. The reloadable fuse dispensing system, as recited in claim 5, further comprises a shock tube and a cap, wherein said dispenser body further has an accessory pocket provided to receive said shock tube and said cap therein.

9. The reloadable fuse dispensing system, as recited in claim 1, wherein said dispenser body is divided into a first panel and a second panel integrally extended from said first panel and adapted to be folded on said first panel, wherein each of said first and second panels is provided with said upper holder and said lower holder.

10. The reloadable fuse dispensing system, as recited in claim 9, wherein said dispenser body further comprises a cover panel integrally extended from said second panel, so that said dispenser body is able to be fitly tri-folded into a folder structure by first folding said first panel on said second panel and then folding said cover panel on top of said first panel, wherein said cover panel has an accessory pocket integrally formed on an inner side of said cover panel of said dispenser body.

11. The reloadable fuse dispensing system, as recited in claim 6, wherein said dispenser body is divided into a first panel and a second panel integrally extended from said first panel and adapted to be folded on said first panel, wherein each of said first and second panels is provided with said upper holder and said lower holder, wherein said dispenser body further comprises a cover panel integrally extended from said second panel, so that said dispenser body is able to be fitly tri-folded into a folder structure by first folding said first panel on said second panel and then folding said cover panel on top of said first panel, wherein said accessory pocket is integrally formed on an inner side of said cover panel of said dispenser body.

12. The reloadable fuse dispensing system, as recited in claim 7, wherein said dispenser body is divided into a first panel and a second panel integrally extended from said first panel and adapted to be folded on said first panel, wherein each of said first and second panels is provided with said upper holder and said lower holder, wherein said dispenser body further comprises a cover panel integrally extended from said second panel, so that said dispenser body is able to be fitly tri-folded into a folder structure by first folding said first panel on said second panel and then folding said cover panel on top of said first panel, wherein said accessory pocket is integrally formed on an inner side of said cover panel of said dispenser body.

13. The reloadable fuse dispensing system, as recited in claim 8, wherein said dispenser body is divided into a first panel and a second panel integrally extended from said first panel and adapted to be folded on said first panel, wherein each of said first and second panels is provided with said upper holder and said lower holder, wherein said dispenser body further comprises a cover panel integrally extended from said second panel, so that said dispenser body is able to be fitly tri-folded into a folder structure by first folding said first panel on said second panel and then folding said cover panel on top of said first panel, wherein said accessory pocket is integrally formed on an inner side of said cover panel of said dispenser body.

14. The reloadable fuse dispensing system, as recited in claim 10, wherein said carrier comprises a pad body having a front side and a rear side, a first fastening element provided on said front side of said pad body, and at least a fastener extended from said pad body for detachably fastening on said user, wherein a second fastening element is provided on an outer surface of said second panel, wherein said dispenser is detachably mounted on said carrier by attaching said second fastening element to said first fastening element of said front side of said pad body of said carrier.

15. The reloadable fuse dispensing system, as recited in claim 11, wherein said carrier comprises a pad body having a front side and a rear side, a first fastening element provided on said front side of said pad body, and at least a fastener extended from said pad body for detachably fastening on said user, wherein a second fastening element is provided on an outer surface of said second panel, wherein said dispenser is detachably mounted on said carrier by attaching said second fastening element to said first fastening element of said front side of said pad body of said carrier.

16. The reloadable fuse dispensing system, as recited in claim 12, wherein said carrier comprises a pad body having a front side and a rear side, a first fastening element provided on said front side of said pad body, and at least a fastener extended from said pad body for detachably fastening on said user, wherein a second fastening element is provided on an outer surface of said second panel, wherein said dispenser is detachably mounted on said carrier by attaching said second fastening element to said first fastening element of said front side of said pad body of said carrier.

17. The reloadable fuse dispensing system, as recited in claim 13, wherein said carrier comprises a pad body having a front side and a rear side, a first fastening element provided on said front side of said pad body, and at least a fastener extended from said pad body for detachably fastening on said user, wherein a second fastening element is provided on an outer surface of said second panel, wherein said dispenser is detachably mounted on said carrier by attaching said second fastening element to said first fastening element of said front side of said pad body of said carrier.

18. A reloadable fuse dispensing system for securely mounting a predetermined length of fuse wire in a daisy chained manner, wherein said reloadable fuse dispensing system comprises:

a carrier comprising a pad body having a front side and a rear side, a first fastening element provided on said front side of said pad body, and at least a fastener extended from said pad body for detachably fastening on a user; and two or more dispensers, each of which is arranged to be capable of detachably attaching to said carrier and comprises:

a dispenser body having an outer side and an inner side which has an upper portion and a lower portion provided thereon, wherein a second fastening element is provided on said outer side of said dispenser body substantially between longitudinal ends of said dispenser body, wherein said dispenser is capable of detachably mounting on said carrier by attaching said second fastening element to said first fastening element of said front side of said pad body of said carrier, and a fuse holder arrangement mounted on said dispenser body for detachably holding said fuse wire in position, wherein said fuse holder arrangement comprises an upper holder and a lower holder affixed on said upper portion and said lower portion respectively, wherein said upper holder comprises a plurality of upper loop holders made of elastic material and said lower holder comprises a plurality of lower loop holders made of elastic material;

whereby said predetermined length of fuse wire is capable of looping in a "8" shape manner to form a plurality of upper loops and lower loops continuously so as to mounting on said dispenser body by holding said upper loops of said fuse wire respectively in position by said upper loop holders one by one in sequence and holding said lower loops of said fuse wire respectively in position by said lower loop holder one by one in sequence so as to wed said fuse wire in said daisy chained manner.

19. The reloadable fuse dispensing system as recited in claim 18, wherein each of said upper and lower holders of said fuse holder arrangement comprises a first elastic strap which is spacedly sewn to form a plurality of upper and lower holding pockets to serve as said upper and lower loop holders respectively, whereby said upper loops and lower loops of said fuse wire are held in said upper loop holders of said upper holder and said lower loop holders of said lower holder respectively in such a manner that said upper loops are respectively inserted into said holding pockets of said upper holder one by one in sequence while said lower loops are respectively inserted into said holding pockets of said lower holder one by one in sequence.

20. The reloadable fuse dispensing system, as recited in claim 19, wherein said fuse holder arrangement further comprises at least a second layer of upper holder and lower holder which are second elastic straps stitched on top of said first elastic straps respectively, wherein said second elastic straps are also spacedly sewn to form a plurality of upper and lower pockets to serves as upper and lower loop holders of said second layer of upper holder and lower holder respectively for continuously holding said upper loops and lower loops of said fuse wire in position, whereby said dispenser body is capable of mounting an additional length of said fuse wire by wedding said fuse wire on said upper and lower holding pockets of said second layer of upper holder and lower holder of said second elastic straps respectively after filing up said upper and lower holding pockets of said first elastic straps.

21. The reloadable fuse dispensing system, as recited in claim 18, wherein said plurality of upper and lower loop holders are formed by a plurality of individual holder pockets separately mounted on said dispenser body respectively, wherein said individual loop holders are made of elastic straps each having a same width and are separately and evenly stitched on said upper and lower portion of said dispenser body in rows, whereby said upper loops and lower loops of said fuse wire are held in said upper loop holders of said upper holder and said lower loop holders of said lower holder respectively in such a manner that said upper loops are respectively inserted into said holder pockets of said upper holder one by one in sequence while said lower loops are respectively inserted into said holder pockets of said lower holder one by one in sequence.

22. The reloadable fuse dispensing system, as recited in claim 21, wherein said fuse holder arrangement further comprises at least a second layer of upper holder and lower holder which are additional individual holder pockets made of elastic straps each having a same width and separately and evenly stitched on said upper loop holders and said lower loop holders of said upper holder and said lower holder stitched on said upper and lower portions of said dispenser body respectively, whereby said dispenser body is capable of mounting an additional length of said fuse wire by wedding said fuse wire on said upper and lower holder pockets of said second layer of upper holder and lower holder respectively after filing up said upper and lower holders thereunder.

23. The reloadable fuse dispensing system, as recited in claim 18, wherein said dispenser body is divided into a first panel and a second panel integrally extended from said first panel and adapted to be folded on said first panel, wherein each of said first and second panels is provided with said upper holder and said lower holder, wherein said dispenser body further comprises a cover panel integrally extended from said second panel, so that said dispenser body is able to be fitly tri-folded into a folder structure by first folding said first panel on said second panel and then folding said cover panel on top of said first panel, wherein said cover panel has an accessory pocket integrally formed on an inner side of said cover panel of said dispenser body, wherein said first and second fastening elements are hook and loop fasteners affixed on said front side of said pad body of said carrier and an outer surface of said second panel of said dispenser body respectively.

* * * * *